US009484673B1

(12) United States Patent
Yang

(10) Patent No.: US 9,484,673 B1
(45) Date of Patent: Nov. 1, 2016

(54) SIGNAL TERMINAL OF VERTICAL BILAYER ELECTRICAL CONNECTOR

(71) Applicant: ALL BEST PRECISION TECHNOLOGY CO., LTD., Taoyuan (TW)

(72) Inventor: Haven Yang, New Taipei (TW)

(73) Assignee: ALL BEST PRECISION TECHNOLOGY CO., LTD., Taoyuan (TW)

( * ) Notice: Subject to any disclaimer, the term of this patent is extended or adjusted under 35 U.S.C. 154(b) by 0 days.

(21) Appl. No.: 14/828,355

(22) Filed: Aug. 17, 2015

(51) Int. Cl.
*H01R 13/6461* (2011.01)
*H01R 13/02* (2006.01)

(52) U.S. Cl.
CPC ..... *H01R 13/6461* (2013.01); *H01R 13/02* (2013.01)

(58) Field of Classification Search
USPC ..... 439/816, 660, 607.07, 626, 108
See application file for complete search history.

(56) References Cited

U.S. PATENT DOCUMENTS 7,824,197 B1 * 11/2010 Westman ..... H01R 13/6586 439/108
8,226,441 B2 * 7/2012 Regnier ..... H01R 9/038 439/626
9,004,942 B2 * 4/2015 Paniagua ..... H01R 13/6581 439/607.07
9,124,036 B2 * 9/2015 Tai ..... H01R 13/6461
2006/0189212 A1 * 8/2006 Avery ..... H01R 12/724 439/607.05
2011/0300757 A1 * 12/2011 Regnier ..... H01R 29/00 439/626
2012/0034820 A1 * 2/2012 Lang ..... H01R 13/65802 439/660

* cited by examiner

*Primary Examiner* — Alexander Gilman
(74) *Attorney, Agent, or Firm* — WPAT, P.C., Intellectual Property Attorneys; Anthony King

(57) ABSTRACT

A signal terminal of a vertical bilayer electrical connector provided forwardly with a plugging surface having thereon an upper plugging hole and a lower plugging hole and provided downwardly with an electrical connection surface includes a conductive body having at least a bump and/or at least a dent at two ends, wherein the at least a bump is parallel to a plane perpendicular to the plugging surface and the at least a dent is parallel to a plane perpendicular to the plugging surface; a resilient electrical contact segment connected to an end of the conductive body and disposed in the upper or lower plugging hole; and an electrical connection segment connected to another end of the conductive body and mounted on the electrical connection surface to thereby electrically connect with a circuit board. Therefore, the signal terminal is effective in adjusting an impedance, reducing loss, and eliminating delay skew.

3 Claims, 6 Drawing Sheets

SIGNAL TERMINAL OF VERTICAL BILAYER ELECTRICAL CONNECTOR

FIELD OF THE INVENTION

The present invention relates to signal terminals of vertical bilayer electrical connectors and more particularly to a signal terminal of a vertical bilayer electrical connector, characterized in that the signal terminal is conducive to adjustment of an impedance, reduction of loss, and elimination of delay skew.

BACKGROUND OF THE INVENTION

Referring to FIG. 1, a conventional signal terminal 5 essentially comprises a conductive body 51, a resilient electrical contact segment 52 and an electrical connection segment 53. The resilient electrical contact segment 52 is connected to an upper end of the conductive body 51. The electrical connection segment 53 is connected to a lower end of the conductive body 51. The resilient electrical contact segment 52 is adapted to be in electrical contact with an electrical connector (not shown) of an external electronic device. The electrical connection segment 53 is adapted to electrically connect with a circuit board (not shown). However, the conductive body 51 of the conventional signal terminal 5 is slender and plate-shaped, and thus it fails to adjust impedance in order to reduce loss. Moreover, the conventional signal terminal 5 cannot eliminate delay skew otherwise caused by length inequality.

Accordingly, it is imperative to provide a signal terminal of a vertical bilayer electrical connector, characterized in that the signal terminal is conducive to adjustment of an impedance, reduction of loss, and elimination of delay skew.

SUMMARY OF THE INVENTION

In view of the aforesaid drawbacks of the prior art, the inventor of the present invention conceived room for improvement in the prior art and thus conducted extensive researches and experiments according to the inventor's years of experience in the related industry, and finally developed a signal terminal of a vertical bilayer electrical connector as disclosed in the present invention, characterized in that the signal terminal is conducive to adjustment of an impedance, reduction of loss, and elimination of delay skew.

In order to achieve the above and other objectives, the present invention provides a signal terminal of a vertical bilayer electrical connector, with the electrical connector provided forwardly with a plugging surface having thereon an upper plugging hole and a lower plugging hole and provided downwardly with an electrical connection surface, the signal terminal comprising: a conductive body having at least one of at least a bump and at least a dent at two ends, wherein the at least a bump is parallel to a plane perpendicular to the plugging surface and the at least a dent is parallel to a plane perpendicular to the plugging surface; a resilient electrical contact segment connected to an end of the conductive body and disposed in one of the upper plugging hole and the lower plugging hole; and an electrical connection segment connected to another end of the conductive body and mounted on the electrical connection surface to thereby electrically connect with a circuit board.

As regards the signal terminal, the electrical connection segment and the neighboring electrical connection segment lies respectively on different transverse planes parallel to the plugging surface.

As regards the signal terminal, a stop bump is disposed at another end of the conductive body.

Hence, the signal terminal of the present invention is conducive to adjustment of an impedance, reduction of loss, and elimination of delay skew.

BRIEF DESCRIPTION OF THE DRAWINGS

Objectives, features, and advantages of the present invention are hereunder illustrated with specific embodiments in conjunction with the accompanying drawings, in which.

DETAILED DESCRIPTION OF THE PREFERRED EMBODIMENTS

Figure 1:
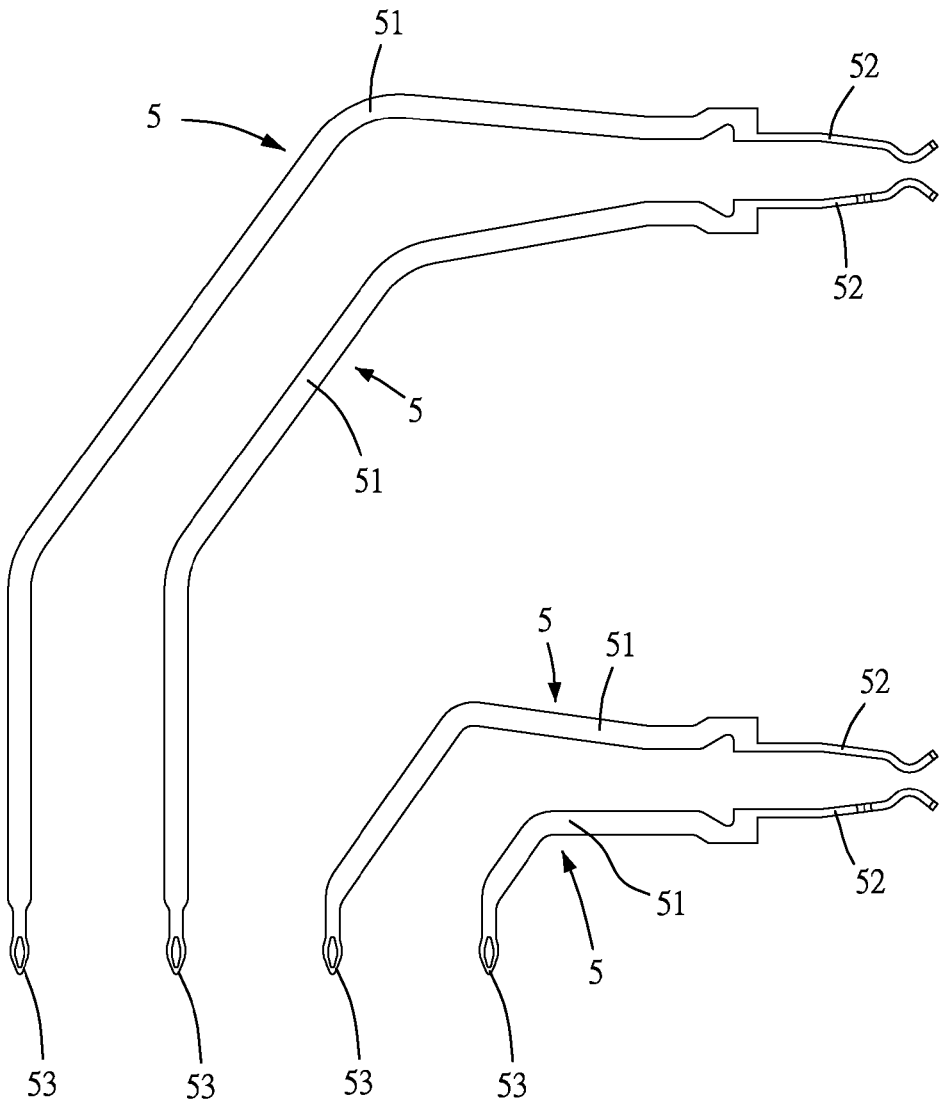
(PRIOR ART) FIG.1
FIG. 1 (PRIOR ART) is a schematic view of a conventional signal terminal.
Figure 2:
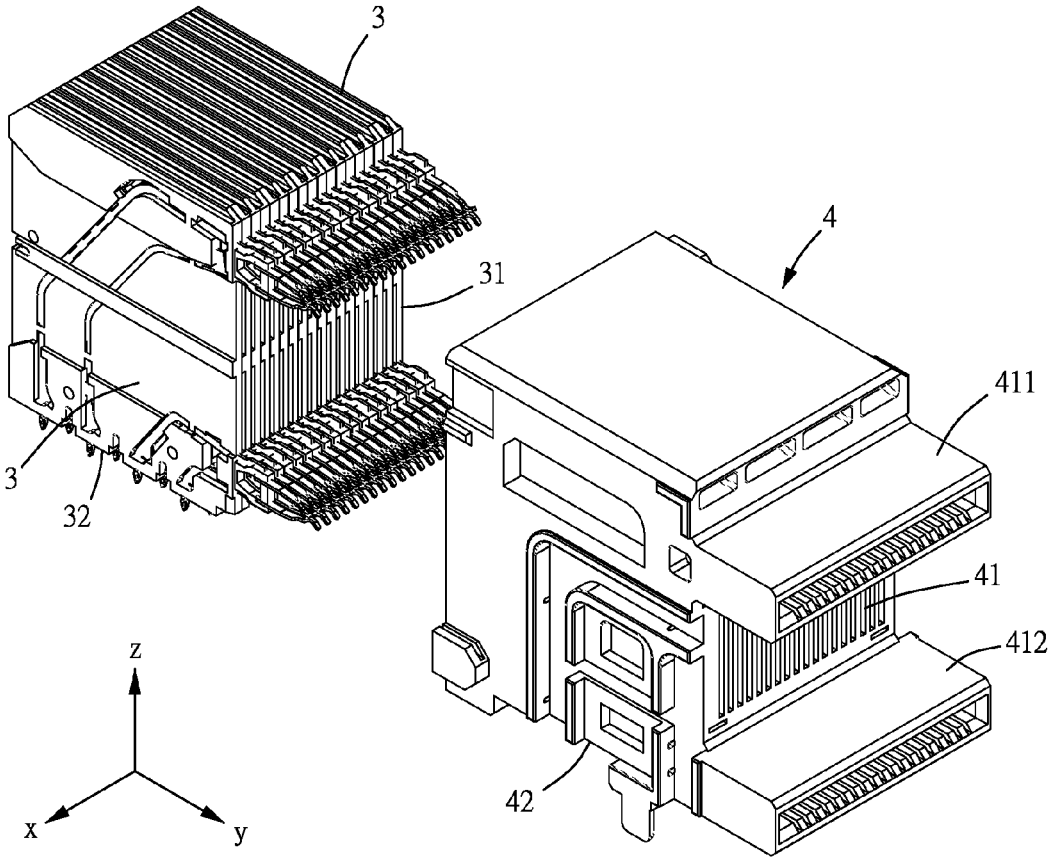
FIG. 2 is a schematic perspective view of a signal terminal for use with an electrical connector according to a preferred embodiment of the present invention.
Figure 3:
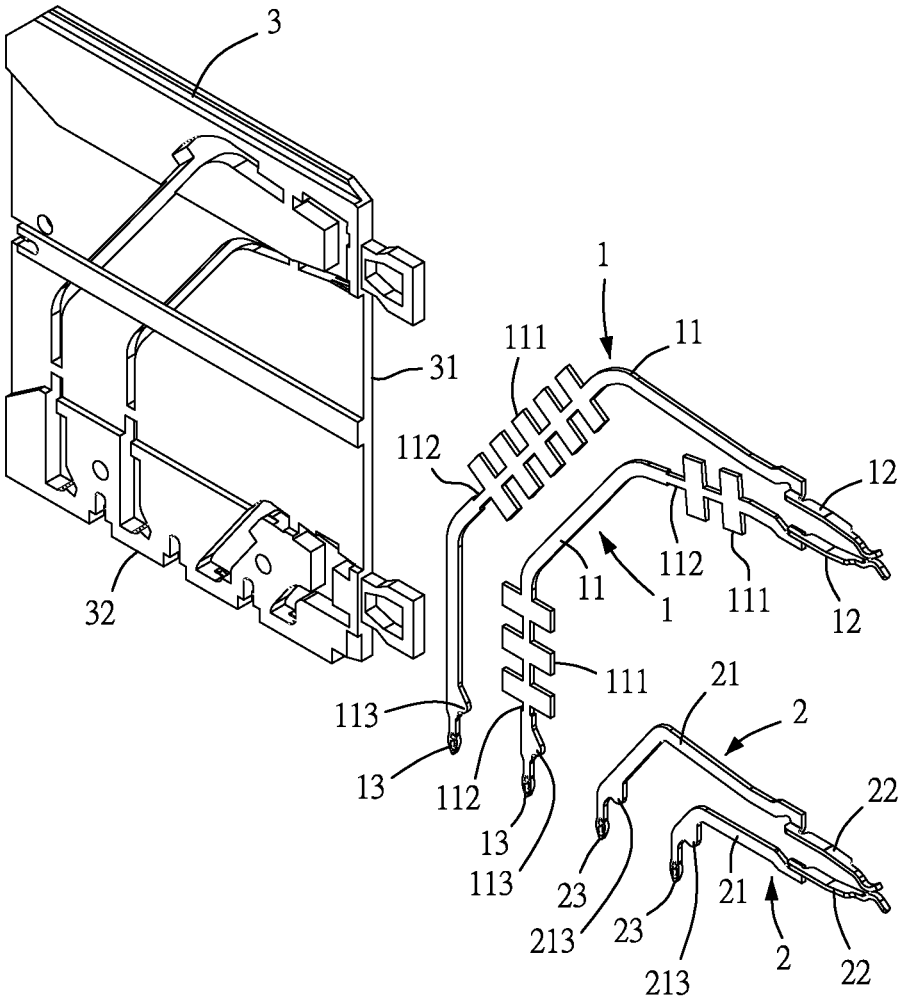
FIG. 3 is a schematic perspective view 1 of the signal terminal according to the preferred embodiment of the present invention.
Figure 4:
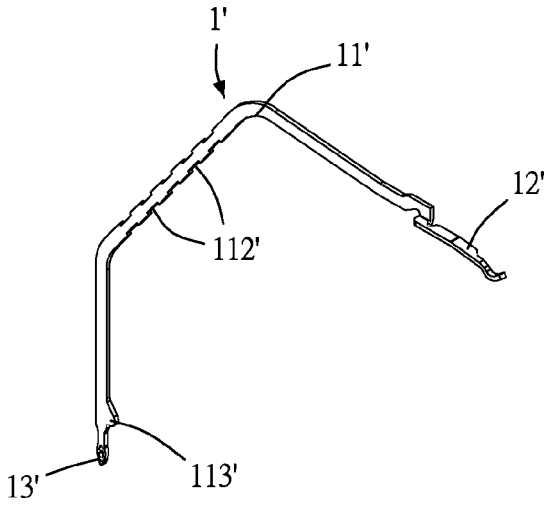
FIG. 4 is a schematic perspective view 2 of the signal terminal according to the preferred embodiment of the present invention.
Figure 5:
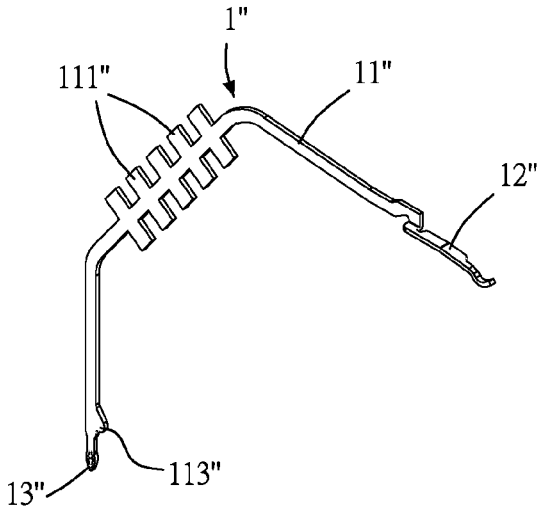
FIG. 5 is a schematic perspective view 3 of the signal terminal according to the preferred embodiment of the present invention.

Referring to FIG. 2, the present invention provides a signal terminal 1, 1', 1" of a vertical bilayer electrical connector 4 (shown in FIG. 3, FIG. 4 and FIG. 5). The electrical connector 4 is provided forwardly with a plugging surface 41. The plugging surface 41 has thereon an upper plugging hole 411 and a lower plugging hole 412. The upper plugging hole 411 and the lower plugging hole 412 are each adapted to admit an electrical connector (not shown) of an external electronic device. The electrical connector 4 is provided downwardly with an electrical connection surface 42. The electrical connector 4 can be mounted on a circuit board (not shown) through the electrical connection surface 42. Referring to FIG. 3, FIG. 4 and FIG. 5, the signal terminal 1, 1', 1" comprises a conductive body 11, 11', 11", a resilient electrical contact segment 12, 12', 12" and an electrical connection segment 13, 13', 13". The conductive bodies 11, 11', 11", each of which is slender and plate-shaped, are parallel to a plane (i.e., plane yz shown in FIG. 2) perpendicular to the plugging surface 41 so as to reduce the required quantity of the conductive bodies 11, 11', 11" and their required thickness when they are disposed alongside an insert injection board 3. Between its two ends, the conductive body 11, 11', 11" has at least a bend. Between its two ends, the conductive body 11, 11', 11" has at least a bump 111 and at least a dent 112 (shown in FIG. 3), only at least a dent 112' (shown in FIG. 4), or only at least a bump 111" (shown in FIG. 5). The bumps 111, 111" are parallel to a plane (i.e., plane yz shown in FIG. 2) perpendicular to the plugging surface 41. The dents 112, 112' are parallel to a plane (i.e., plane yz shown in FIG. 2) perpendicular to the plugging surface 41. The bumps 111, 111" and the dents 112, 112' are disposed at any appropriate points of the conductive bodies 11, 11', 11". The bumps 111, 111" are in the number of one or provided in the plural, so are the dents 112, 112'. In the latter case, a symmetry or asymmetry is present between the bumps 111, 111", between the dents 112, 112', or between the bump 111, 111" and the dent 112, 112'. The resilient electrical contact segment 12, 12', 12" is connected to the upper end of the conductive body 11, 11', 11". The resilient electrical contact segment 12, 12', 12" is disposed in the upper plugging hole 411 or the lower plugging hole 412 to therefore, upon its resilient deformation, come into electrical contact with the electrical connector of an external electronic device. The electrical connection segment 13, 13', 13" is connected to the lower end of the conductive body 11, 11', 11". The electrical connection segment 13, 13', 13" is adapted to be mounted on the electrical connection surface 42 and thus welded to the circuit board. Referring to FIG. 2 and FIG. 3, the signal terminal 1 of the present invention is disposed in an insert injection board 3 by insert injection molding, and then the resilient electrical contact segment 12 of the signal terminal 1 is exposed from a plugging side 31 of the insert injection board 3 and the electrical connection segment 13 of the signal terminal 1 is exposed from an electrical connection side 32 of the insert injection board 3. Afterward, the signal terminal 1 of the present invention, any other signal terminal, any other ground terminal, and its insert injection board are put in the electrical connector 4. Referring to FIG. 2, the signal terminal 1 of the present invention operates in conjunction with a signal terminal 2 not equipped with any bump or dent.

As mentioned before, the signal terminal 1 of the present invention is conducive to the adjustment of the surface area of a signal terminal by means of a bump or a dent to thereby be conducive to the adjustment of an impedance, the reduction of loss, and elimination of delay skew otherwise caused by the inequality of lengths of the signal terminals.

Figure 6:
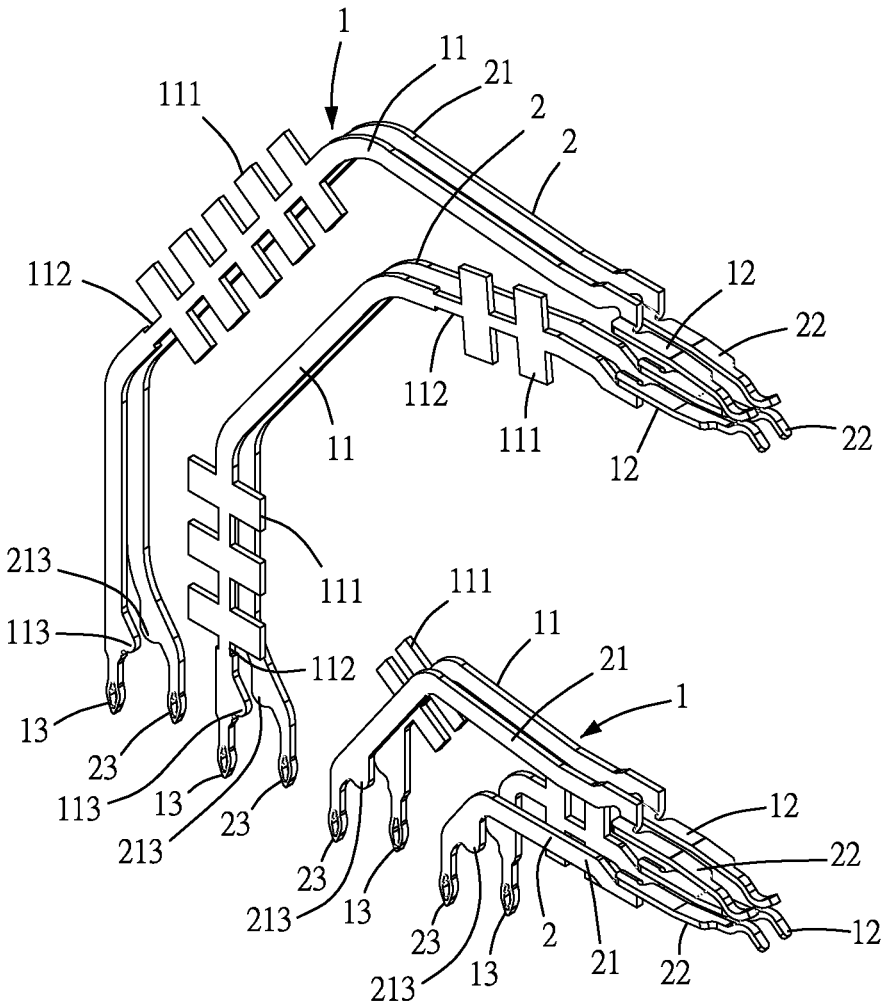
FIG. 6 is a schematic perspective view 4 of the signal terminal according to the preferred embodiment of the present invention.
Figure 7:
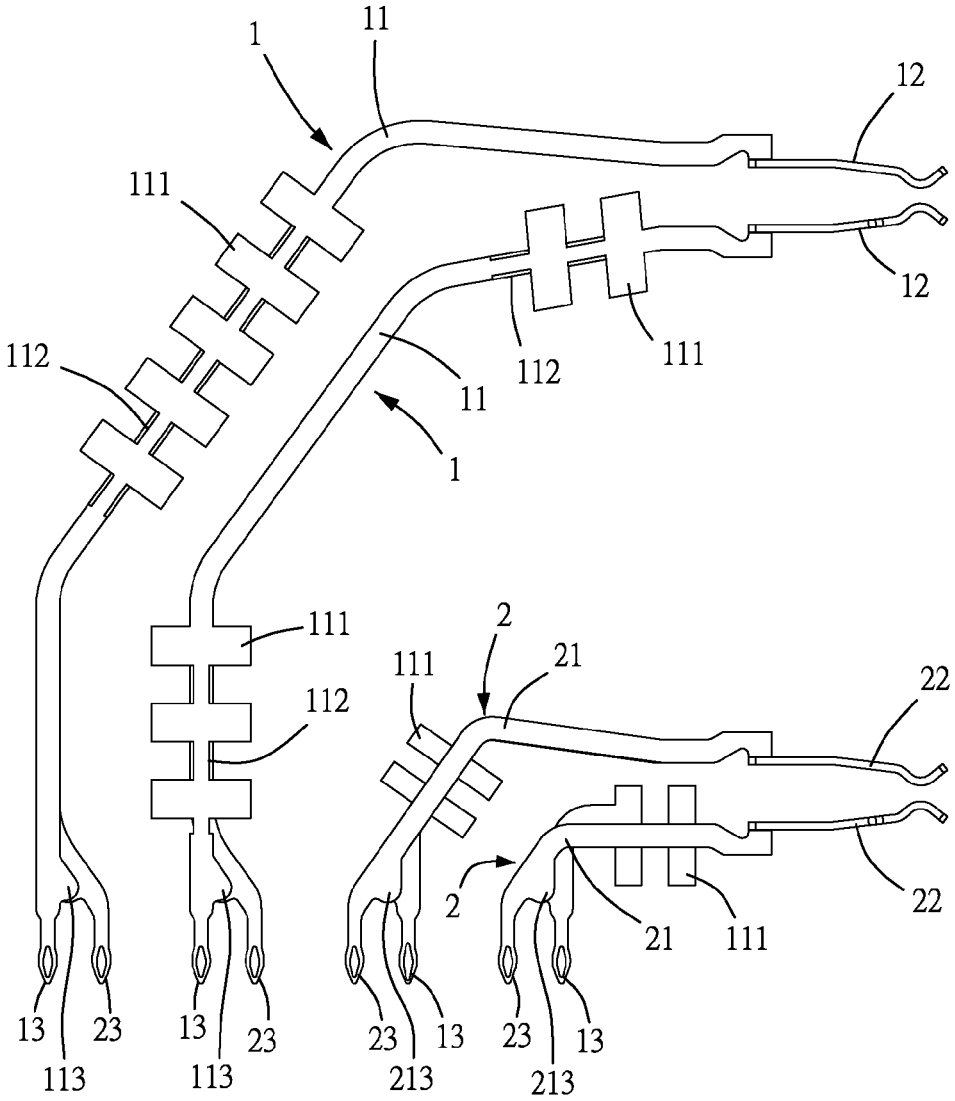
FIG. 7 is a front view of the signal terminal shown in FIG. 6.

Referring to FIG. 6 and FIG. 7, regarding the signal terminal 1 of the present invention, the electrical connection segment 13 and the neighboring electrical connection segment 23 lie on different transverse planes, respectively, and are formed by bending the conductive body 11 or bending the neighboring conductive body 21, wherein the transverse planes are parallel to the plugging surface 41 (shown in FIG. 2). Hence, according to the present invention, the electrical connection segment 13 and the neighboring electrical connection segment 23 lie on different transverse planes, respectively, to reduce crosstalk.

Referring to FIG. 6 and FIG. 7, regarding the signal terminal 1 of the present invention, a stop bump 113 is laterally disposed at the lower end of the conductive body 11. Hence, the signal terminal 1 is capable of adjusting an impedance by the stop bump 113.

The present invention is disclosed above by preferred embodiments. However, persons skilled in the art should understand that the preferred embodiments are illustrative of the present invention only, but should not be interpreted as restrictive of the scope of the present invention. Hence, all equivalent modifications and replacements made to the aforesaid embodiments should fall within the scope of the present invention. Accordingly, the legal protection for the present invention should be defined by the appended claims.

What is claimed is:

1. A signal terminal of a vertical bilayer electrical connector, with the electrical connector provided forwardly with a plugging surface having thereon an upper plugging hole and a lower plugging hole and provided downwardly with an electrical connection surface, the signal terminal comprising:

a conductive body having at least one of at least a bump and at least a dent between two ends, wherein the at least a bump is parallel to a plane perpendicular to the plugging surface and the at least a dent is parallel to a plane perpendicular to the plugging surface;

a resilient electrical contact segment connected to an end of the conductive body and disposed in one of the upper plugging hole and the lower plugging hole; and an electrical connection segment connected to another end of the conductive body and mounted on the electrical connection surface to thereby electrically connect with a circuit board.

2. The signal terminal of claim 1, wherein the electrical connection segment and the neighboring electrical connection segment lies respectively on different transverse planes parallel to the plugging surface.

3. The signal terminal of claim 1, wherein a stop bump is disposed at another end of the conductive body.

* * * * *